US005323690A

United States Patent [19]

Sims

[11] Patent Number: 5,323,690

[45] Date of Patent: Jun. 28, 1994

[54] FLUID ACTUATOR ASSEMBLY FOR IMPARTING ROTATIONAL MOVEMENT TO A BOOM

[76] Inventor: James O. Sims, 1100 Brooks St., Decatur, Ala. 35601

[21] Appl. No.: 28,936

[22] Filed: Mar. 5, 1993

[51] Int. Cl.[5] ..... F01B 11/02

[52] U.S. Cl. ..... 92/85 R; 92/85 A; 92/85 B; 92/143; 92/136; 92/68; 92/146; 92/161; 74/29; 74/30; 212/248

[58] Field of Search ..... 92/2, 85 R, 85 A, 85 B, 92/68, 136, 171.1, 146, 147, 151, 161, 143; 212/248; 74/29, 30

[56] References Cited

U.S. PATENT DOCUMENTS 2,285,862 6/1942 Jeffrey et al. ..... 212/248
2,796,998 6/1957 Sundin ..... 212/248
3,003,649 10/1961 Przybylski ..... 212/248
3,447,423 6/1969 Henry ..... 92/136
3,605,409 9/1971 Heese et al. ..... 92/147
3,776,100 12/1973 Yeh ..... 92/181 R
3,803,925 4/1974 Jackson ..... 74/89.17

*Primary Examiner*—Thomas E. Denion
*Attorney, Agent, or Firm*—Phillips & Beumer

[57] ABSTRACT

A linear movable apparatus for imparting rotational movement to a turntable is provided. The turntable is secured to a rotatably mounted shaft having a ring gear thereon for meshed engagement with gear teeth provided on a piston rod which extends between a pair of pistons. Each piston is reciprocally carried in aligned cylinder housings mounted in a support structure. An adjustable mechanism is provided for retaining the piston rod in snug-fitting relation with the ring gear, and a bracket assembly is secured around the ring gear to support the adjustable mechanism against the ring gear.

6 Claims, 10 Drawing Sheets

FLUID ACTUATOR ASSEMBLY FOR IMPARTING ROTATIONAL MOVEMENT TO A BOOM

FIELD OF THE INVENTION

The present invention is generally directed to a double-acting fluid actuator assembly and more particularly to such a fluid actuator assembly having a reciprocally movable piston rod provided with a piston on opposite ends thereof and an intermediate rod portion which is provided with means for engaging and imparting rotational movement to an object, such as a boom.

BACKGROUND OF THE INVENTION

Devices for imparting rotation to a boom are well known in the art. One such device is described in U.S. Pat. No. 3,964,512 which discloses a pipe boom used in conjunction with a slurry pump for delivering and placing concrete. The boom is rotated by an externally mounted drive sprocket secured to the boom shaft and rotated by a chain which extends around the drive sprocket and the gear of a motor. In such chain driven devices, the chain tends to expand and wear after extended use and fit sloppily around the sprocket. Also, such structures are inherently dangerous inasmuch as an individual may be injured by placing his fingers too close to the externally mounted drive assembly and accidentally getting his fingers caught between the sprocket and chain.

It is, therefore, an object of the present invention to provide a linear movable apparatus for imparting rotational movement to an object.

It is a further object of the present invention to provide the apparatus with a rack and pinion type drive mechanism having means for retaining the gears of the rack and pinion drive in snug fitting engagement.

It is yet a further object of the present invention to provide such a drive mechanism with means for enclosing the rack and pinion drive mechanism to protect the drive mechanism and to also serve to protect an individual from injury by the drive mechanism.

DESCRIPTION OF THE PREFERRED EMBODIMENT

Figure 1:
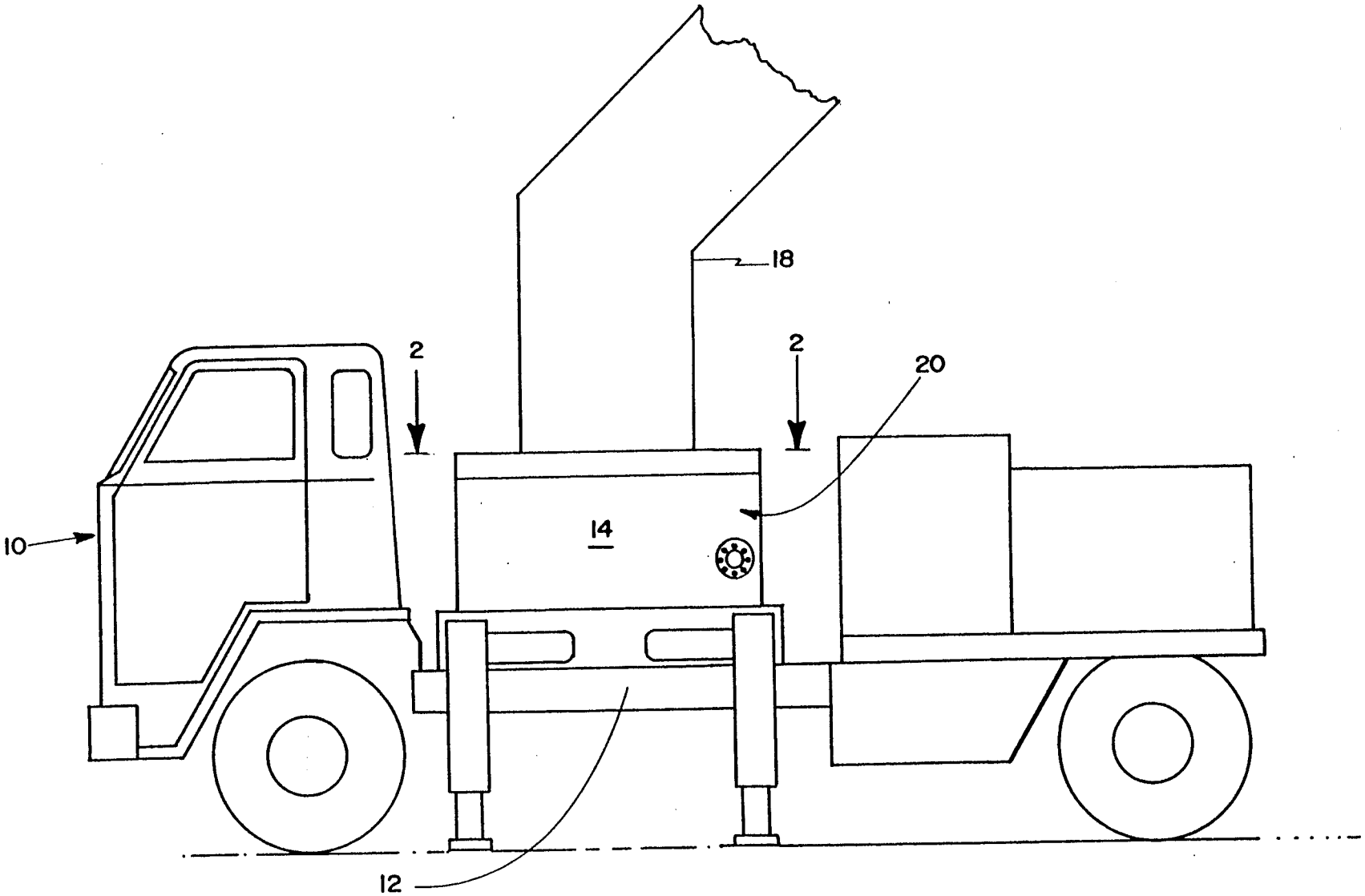
FIG. 1 is a side elevational view of a boom mounted on a support assembly which is mounted on a transport vehicle. The support assembly includes a turntable which rotatably supports the boom and is rotatable by the fluid actuator assembly of the present invention.

As seen in FIG. 1, a vehicle 10 is shown to include a frame 12 for supporting a boom support assembly 14 including a turntable 16 which supports a boom 18 thereon for rotatable movement therewith. An enclosure 20 encloses the boom support assembly 14.

Figure 2:
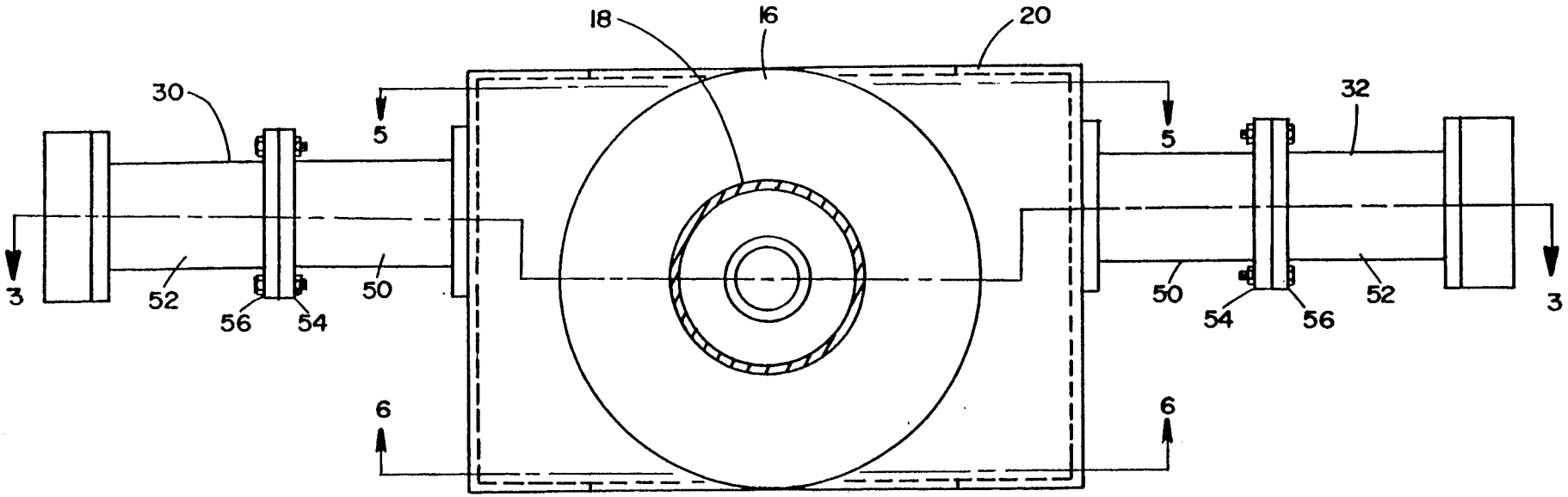
FIG. 2 is an enlarged sectional view taken along line 2—2 of FIG. 1.
Figure 3:
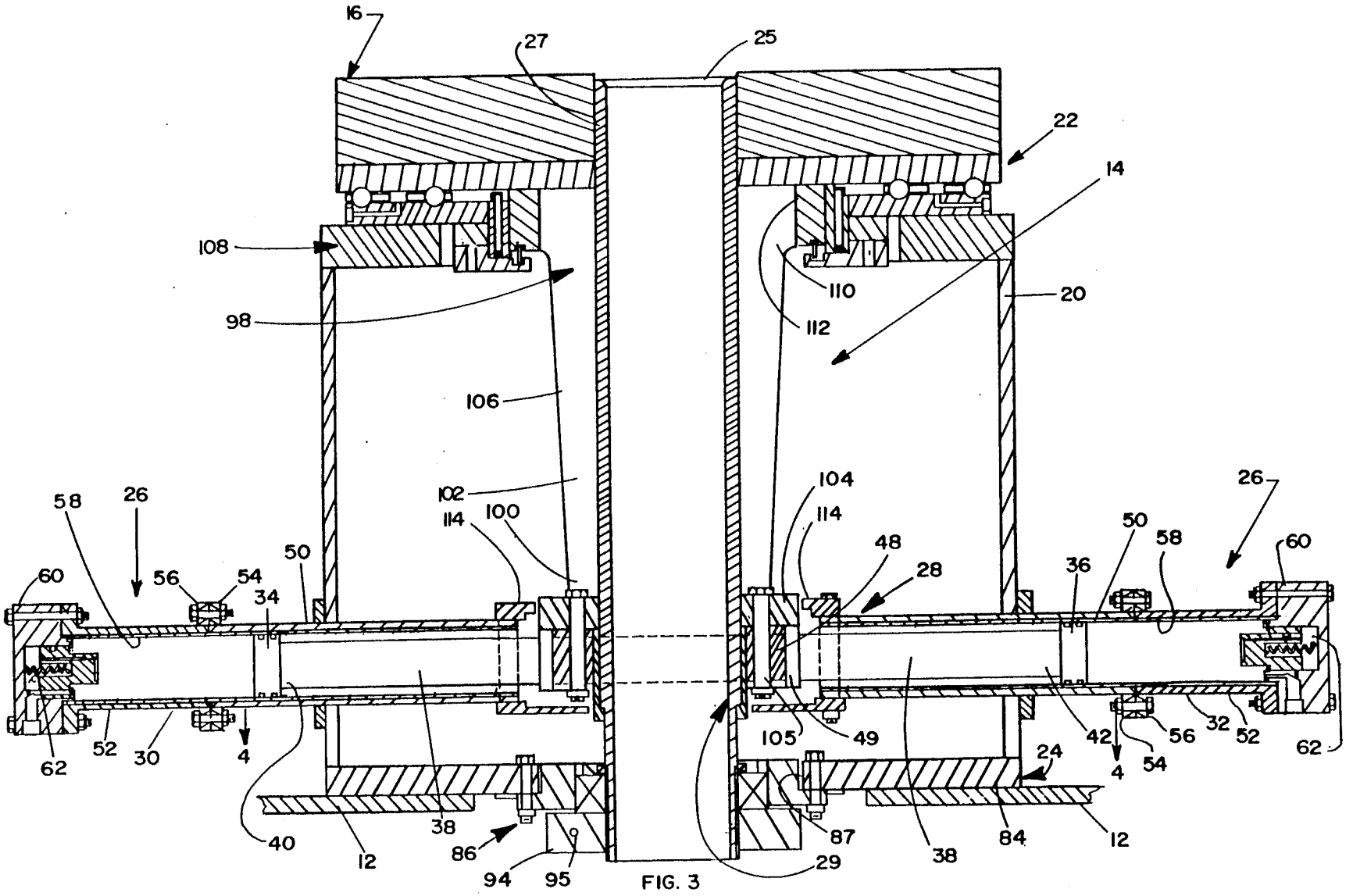
FIG. 3 is a sectional view taken along line 3—3 of FIG. 2 illustrating the rotational turntable and support therefor and the fluid actuator means for rotating the turntable. The fluid actuator assembly is shown to include a pair of cylinders having a linear brake assembly at the end of each actuator cylinder.
Figure 4:
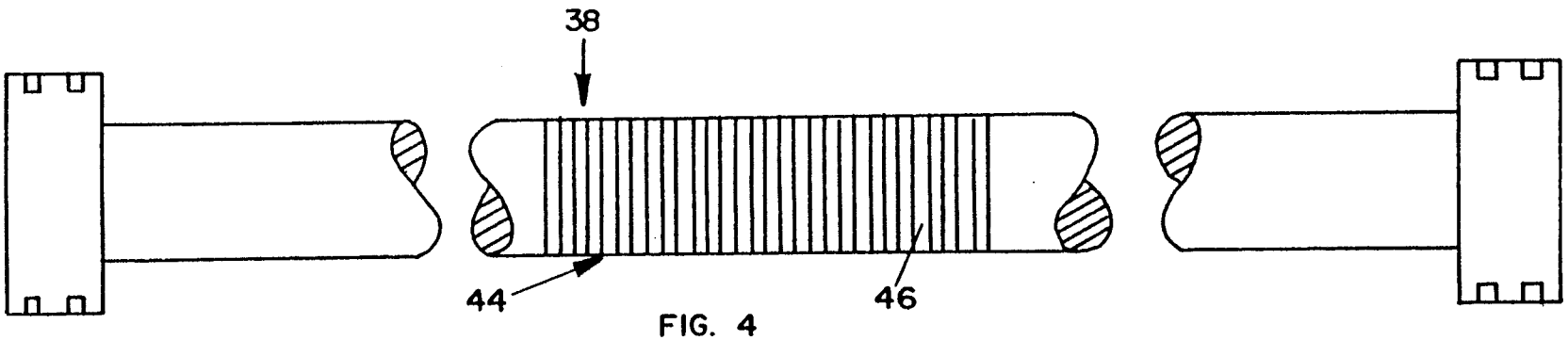
FIG. 4 is an elevational view of the piston rod of FIG. 3 including the intermediate portion thereof having gear teeth thereon.
Figure 5:
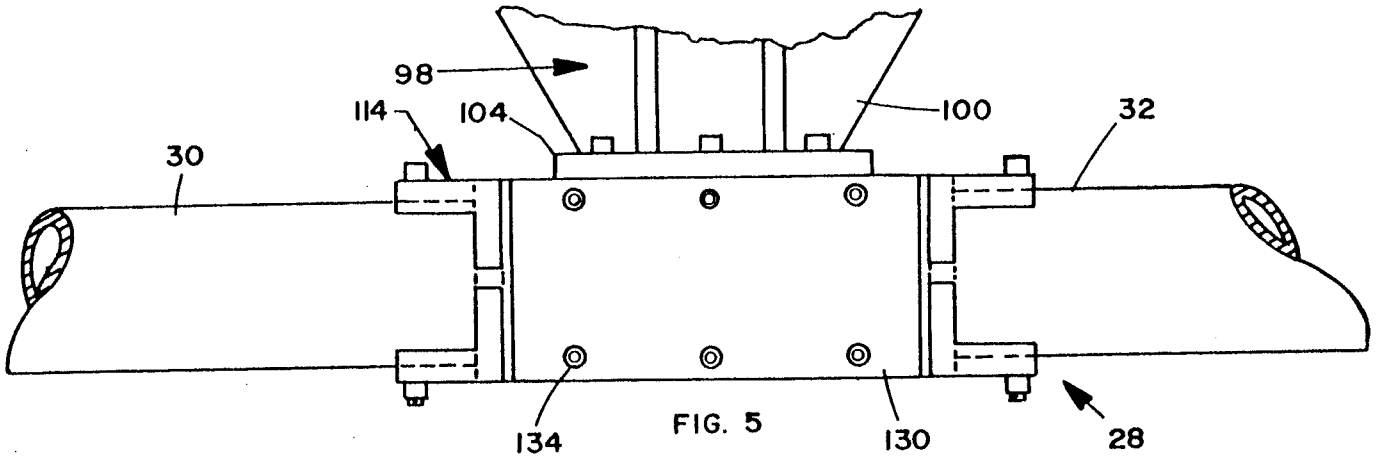
FIG. 5 is a sectional view taken along line 5—5 of FIG. 2.
Figure 6:
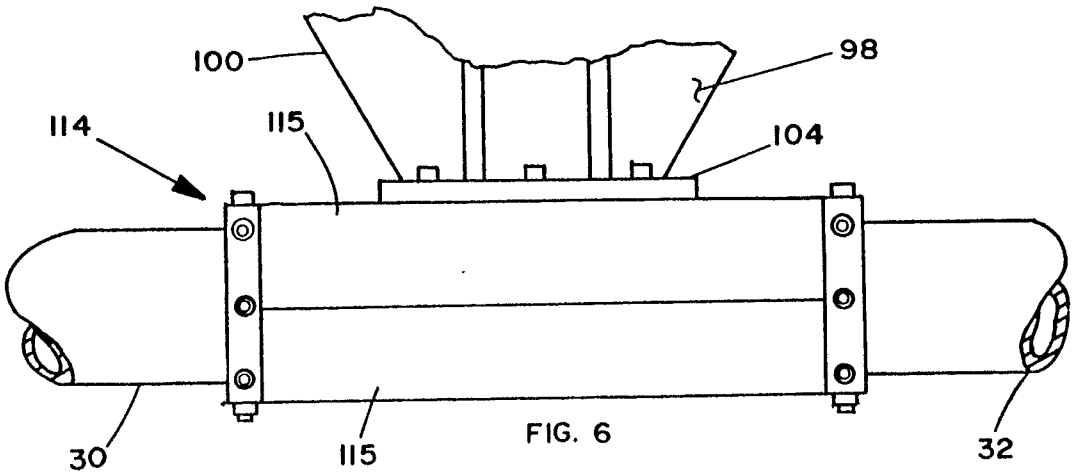
FIG. 6 is a sectional view taken along line 6—6 of FIG. 2.
Figure 8:
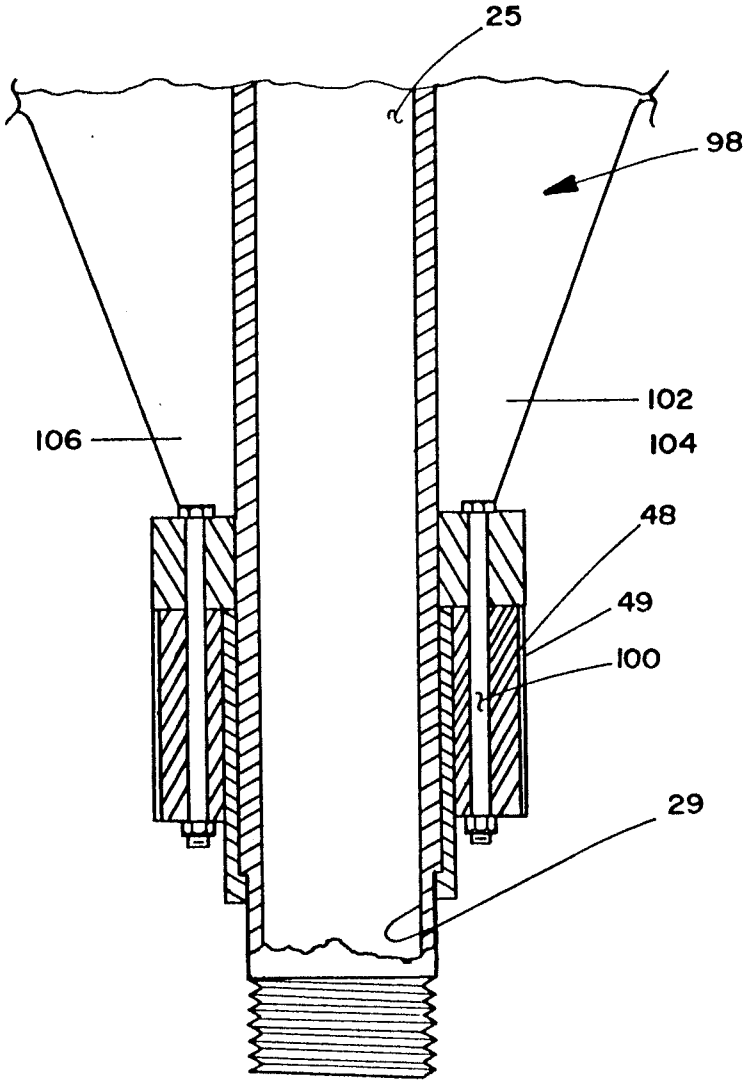
FIG. 8 is an enlarged elevational view, partially in section, of the turntable shaft having a ring gear (pinion) mounted thereon.

As seen in FIG. 3, the boom support assembly 14 includes an upper portion 22 for support of turntable 16 and a base portion 24 for attachment to frame 12. A shaft 25 has an upper end 27 to which is secured the turntable 16 and a lower portion 29 which extends downwardly for support in base portion 24 of the support assembly. A pair of fluid actuator assemblies 26 form a linear actuator mechanism (FIGS. 2 and 3) which is provided for imparting rotational movement to the turntable as described hereinbelow. The actuator assemblies are similar, and each assembly includes a pair of cylinder housings 30 and 32, respectively, enclosing a pair of pistons 34 and 36 connected by a single piston rod 38. Piston 34 is secured to end 40 of piston rod 38, and piston 36 is secured to end 42 of piston rod 38. The rod 38 (FIG. 4) has a rectangular cross section and includes an intermediate section 44 which is provided with a plurality of gear teeth 46 which form a rack for meshed engagement with a circular gear 48 (FIGS. 3 and 8) rigidly secured to the lower portion 29 of the rotatable main shaft 25. As seen in FIGS. 2 and 3, each cylinder housing 30 and 32 is comprised of separate cylindrical housing sections 50 and 52 having end flanges 54 and 56 which are bolted together. A single liner 58 (FIG. 3) may be mounted in housing sections 30 and 32, if desired. The liner extends substantially the length of each cylinder housing assembly 30 and 32. While each cylinder housing 30 and 32 is described as being comprised of sections 50 and 52, it is to be understood that the cylinder housings 30 and 32 may be made of a single cylinder, if desired.

Figure 7:
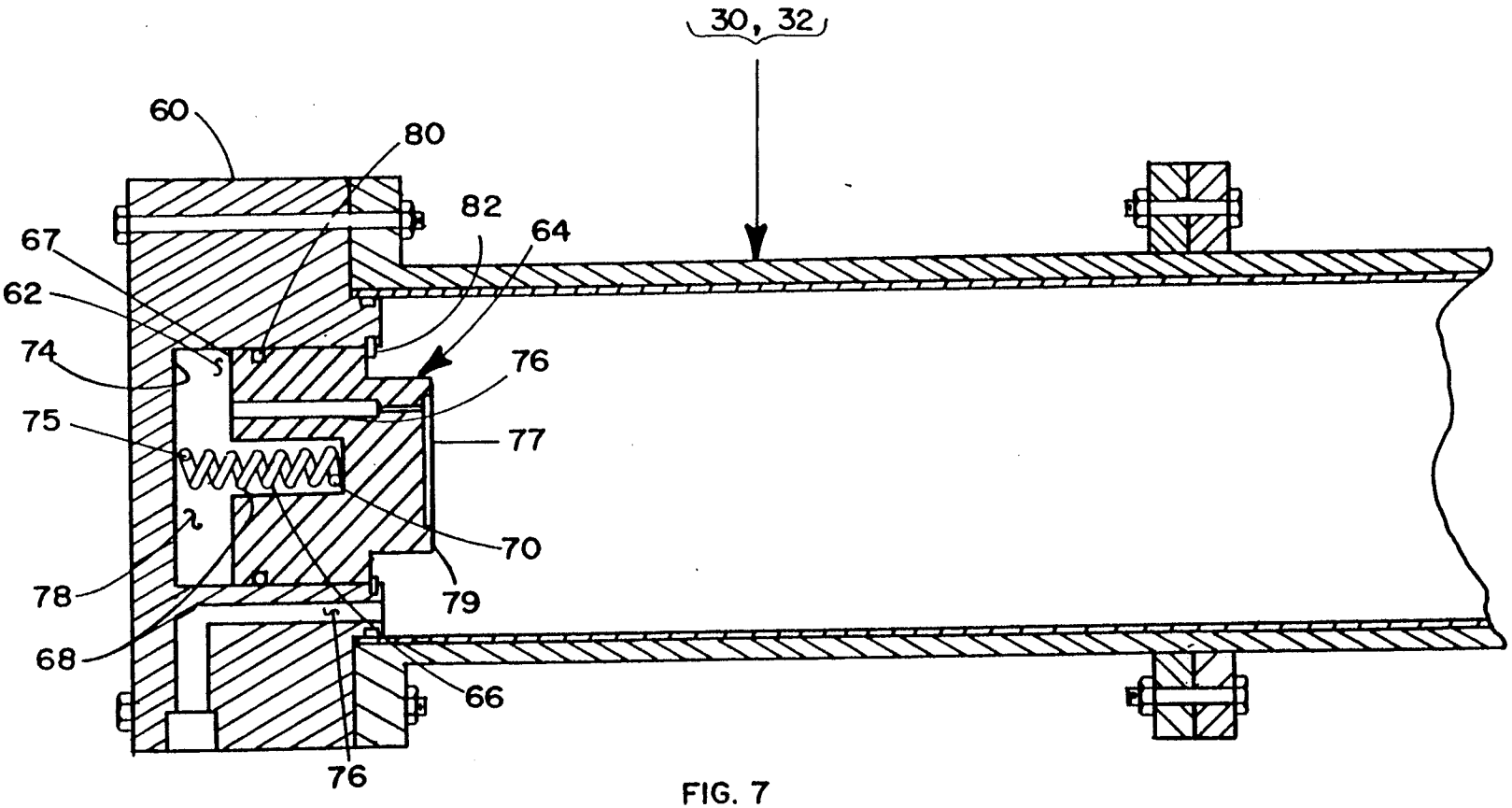
FIG. 7 is an enlarged sectional view of the piston braking system shown in FIG. 3.

The cylinder housing assemblies 30 and 32 are provided with buffering means in the form of a linear brake to brake the pistons when the pistons reach the ends of the cylinder. To this end, each of the cylinder assemblies 30 and 32 includes an end cap 60 which is secured to the end of the respective cylinder assemblies. Each end cap is provided with an annular recess 62 (FIGS. 3 and 7) having an annular buffering member (plug) 64 mounted reciprocally therein. The plug 64 includes a recess 66 in a surface 67 thereof. A spring 68 has one end 70 mounted in recess 66, and the other end 75 of spring 68 seats against an inner surface 74 of recess 62. A port (passage) 76 extends axially through buffering member 64 and is in communication via a port 69 with a space 78 between rear surface 67 of buffering member 64 and the inner surface 74 of the recess 62 of end cap 60. A seal (O-ring or the like) 80 is provided on buffering member 64. Stop means in the form of a removable annular clip member 82 is provided for retention of member 64 in end cap 60. Plug 64 is provided with a forward recessed area 77 to prevent suction between the rear face of the piston and the forward face 79 of plug 14 responsive to mating engagement of the piston and buffering member 84. An annular metering passage 76 extends through member 64 and communicates between the interior of the cylinder housings and space 78 for equalizing pressure in space 78 and in the interior of the cylinder housings.

FIG. 3 illustrates the support assembly 14 including the enclosure 20. As seen in FIG. 3 and as stated above, lower portion 29 of shaft 25 is mounted in the lower portion 24 of the support assembly 14. The lower portion 24 includes a base member 84 for attachment to frame 12 of the vehicle and a bearing assembly 86 for rotatably securing the shaft 24 in the lower support portion 24.

Figure 11:
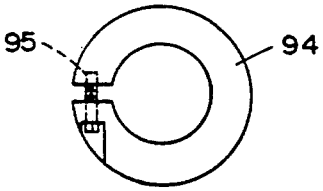
FIG. 11 is a plan view of the split nut (shown in FIG. 3) which holds the shaft against axial movement.

Shaft 25 extends upwardly through bearing assembly 86 which is mounted in an annular opening 87 of base member 84. Bearing assembly 86 is retained in shaft 25 by a split ring member 94 (FIG. 11) having a set screw 95 for secured relation of the split ring to the bottom of shaft 25. Shaft 25 has the turntable 16 secured to its upper end 27 thereof. The turntable is secured to a turntable support assembly 98 which includes a plurality of ribs 102 having lower ends 100 (FIGS. 3, 5, 6, and 8) which are secured to an annular flange 104 which is secured to shaft 25. Ribs 102 of turntable support assembly 98 further includes intermediate portions 106 which extend lengthwise along shaft 25 and are secured thereto by welding or the like. The upper end portion 108 of the turntable support assembly is formed by the outwardly extending ends 110 of the ribs 102 which are secured, by welding or the like, to an annular depending member 112 of turntable 16.

The lower portion 29 of shaft 25 serves to support ring gear 48 thereon by splines or the like (not shown). Ring gear 48 is shown in FIG. 3 to be also secured to flange 104 by bolts 105.

Figure 10:
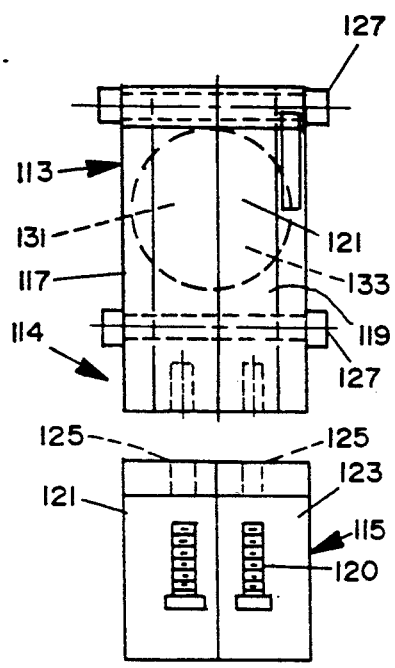
FIG. 10 is a side elevational view taken along line 10—10 of FIG. 8.
Figure 9:
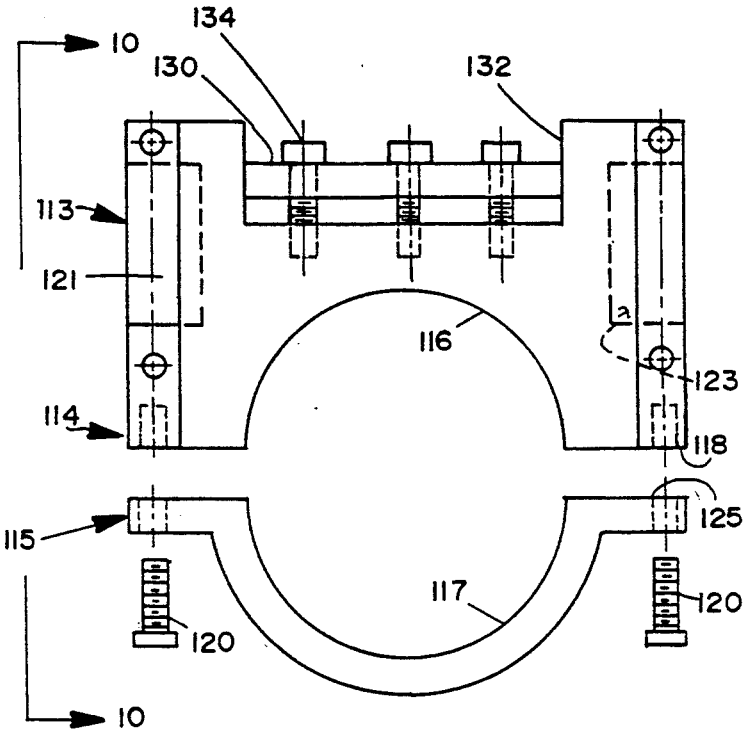
FIG. 9 is an exploded plan view of the enclosure which encloses the meshing portion of the rack gear of the piston rod and the ring gears of FIG. 3.
Figure 15:
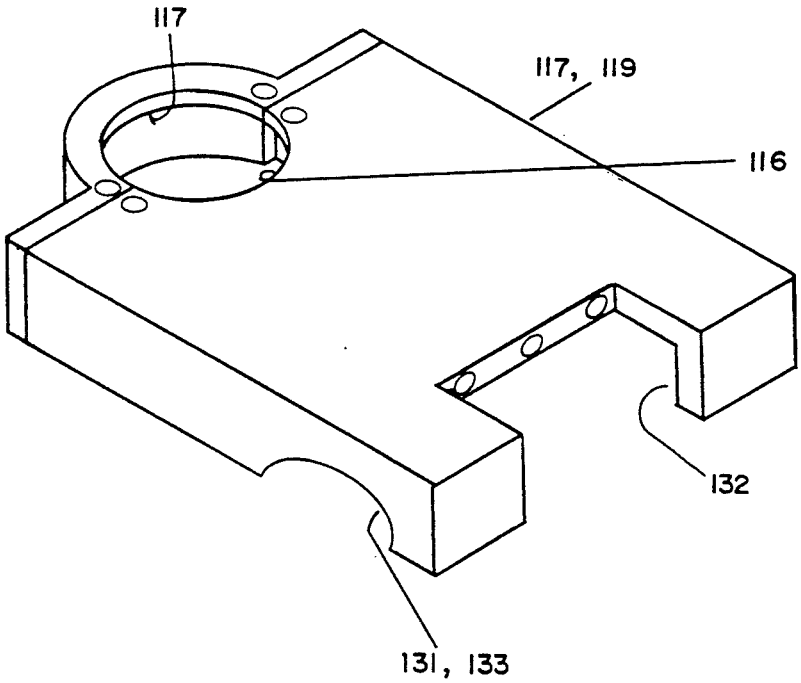
FIG. 15 is a pictorial view of an enclosure member illustrated in FIG. 9.

A retaining bracket assembly 114 (FIGS. 3, 5, 6, 9, and 10) is provided to support the ends of each elongated cylinder and to retain the gear teeth of the piston rod snugly against the annular gear 48 on shaft 25. The bracket includes two sections 113 and 115. Section 113 includes identical inverted and mating members 117 and 119 (FIGS. 9, 10, and 15), each having a semi-circular cut-out portion 116 and a flange portion 118. Section 115 includes identical inverted and mating members 121 and 123 each having a semi-circular cut-out portion 117 and a flanged portion 125. Bolts 120 secure the flanges of each section together around the shaft 25, and bolts 127 secure the inverted members 117 and 119 of section 113 together. Bracket 114 additionally supports the intermediate portion of the piston rods (FIG. 3) for snug-fitting relation of the gear portion of the piston rod with the ring gear of shaft 25. To support the ends of each cylinder housing, members 117 and 119 of section 113 are respectively provided with a semi-circular cut-out portion 131, 133 which forms circular cut-out portion 121, 123 when the members are inverted and mated to receive and support the distal ends of the cylinder housings therein as shown in FIG. 3. FIG. 15 is a pictorial illustration of members 117 and 119.

To retain the gear teeth of the piston rod firmly against the ring gear, an adjustable piston rod support member 130 is provided in bracket 114. The support member 130 is shown (in FIGS. 5, 9, and 13) to be in the form of a plate which is secured adjacent to an opening 132 of the inverted members of bracket 114. The plate is secured to the two inverted members 117 and 119 by screws 134 and are tightened sufficiently to retain the piston rod in a predetermined path, which assures a snug fitting engagement of the teeth of the piston rod with teeth 49 of ring gear 48.

Additional support means for each cylinder is provided by the lower portion 120 of enclosure 20 which supports the cylinders intermediate to the ends thereof. Flanges 121 are provided on the outer periphery of the cylinders for secured relation with the lower portion of enclosure 20.

Figure 12:
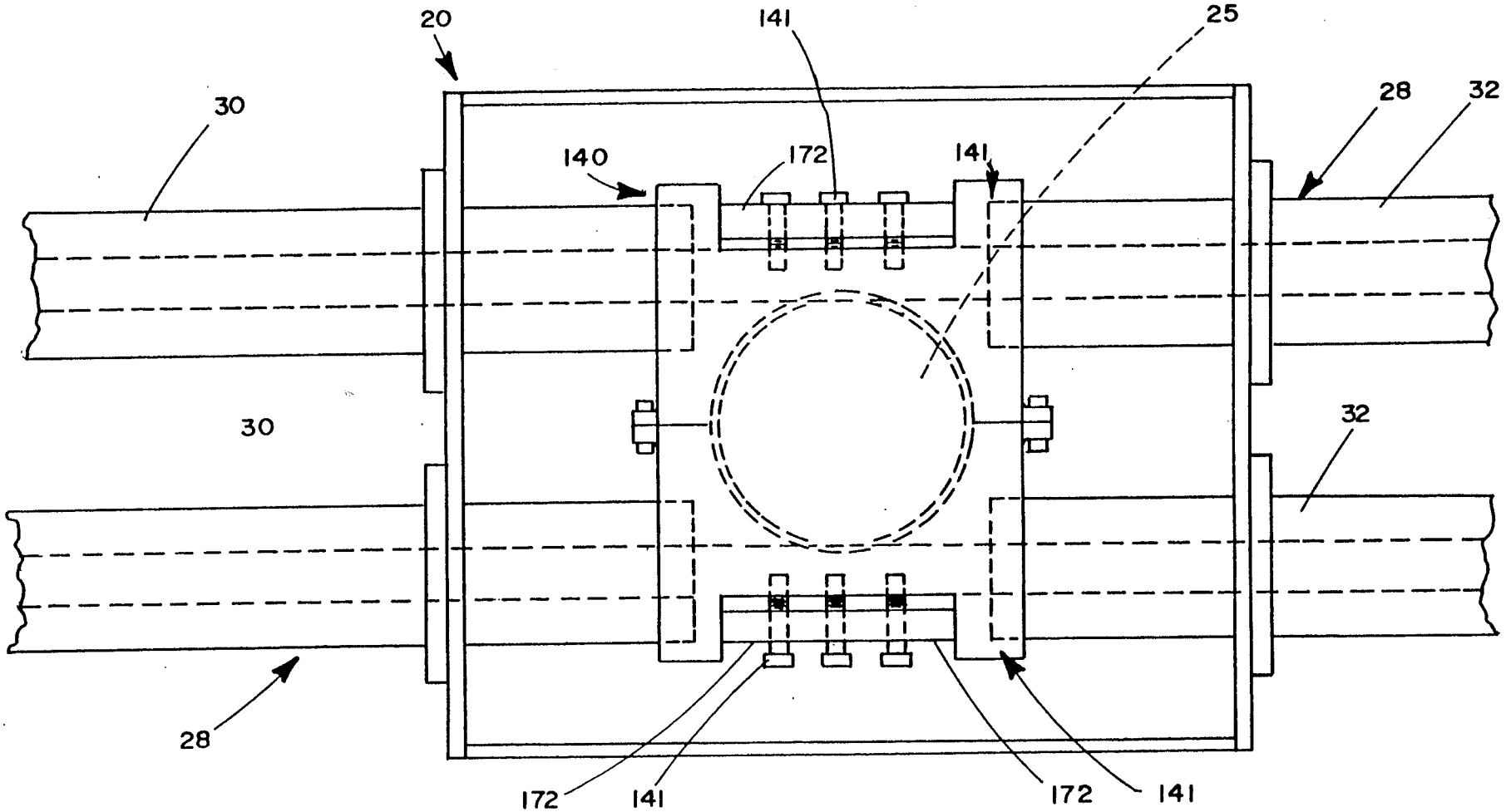
FIG. 12 is a view similar to FIG. 2 illustrating the use of two fluid actuator assemblies, with one actuator assembly being disposed on each side of the turntable shaft.
Figure 14:
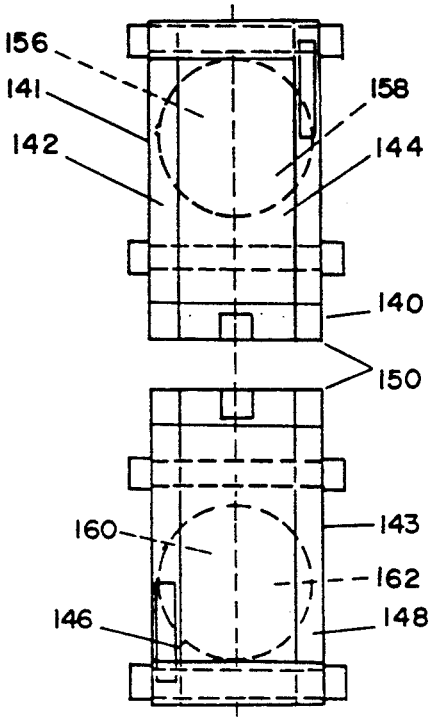
FIGS. 13 and 14 are views similar to FIGS. 9 and 10 illustrating the enclosure for the embodiment of FIG. 12.
Figure 13:
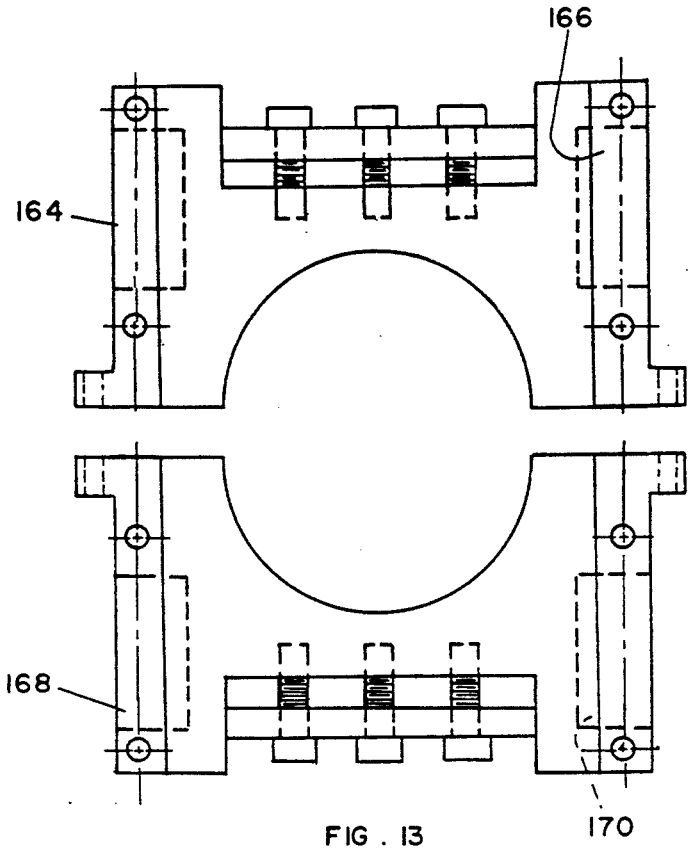

The above discussion has been directed to an embodiment of the invention wherein one fluid actuator assembly is used to rotate ring gear 48 and shaft 25. However, as seen in FIG. 12, two actuator mechanisms 28 may be used, with one actuator mechanism 28 being positioned on each side of shaft 25; however, if two actuator assemblies are used as shown in FIG. 12, a retaining bracket, identified by the numeral 140, is used instead of the retaining bracket 114, described above. As seen in FIGS. 12, 13 and 14, the bracket 140 is comprised of two sections 141 and 143 made up of four identical members 142, 144, 146, and 148 (FIGS. 13 and 14) somewhat similar to the members of section 113 described above and shown in FIG. 15. However, in the embodiment of FIGS. 12 and 13, each member is provided with a flange or projecting "ear" 150 which is disposed for secured relation therebetween to retain the brackets in secured relation around the shaft 25. A retaining bracket assembly 140 is used for each fluid actuator assembly 28, and each of the members 142, 144, 146, and 148 of the bracket 140 is shown to include semi-circular cut-out portions 156, 158, 160, and 162 which form circular cut-out portions 164, 166, 168, and 170 for support of cylinders 30 and 32 of each linear actuator mechanism 28, in the manner described above in conjunction with the discussion of FIGS. 13 and 14. An adjustable plate 172 is shown in FIG. 12 to be adjustably secured to each section 141 and 143 of bracket assembly 140 by fasteners 141 to snugly retain the piston rod against the ring gear as described, supra.

The cylinders are provided with ports which are connected to a source of fluid pressure (not shown). Each of the ports serve to direct fluid into and out of the cylinders so that as fluid pressure is applied against a first piston through a first port, the first piston is moved in a first direction to force fluid in the second cylinder out of its port by movement of the second piston. As fluid pressure is applied against the second piston through the second port, the second piston is moved in a second direction to force fluid in the first cylinder out of its port by movement of the first piston.

I claim:

1. A rotatable boom assembly including linearly movable, rotation-imparting means, comprising:

boom support means including shaft support means for rotatably supporting a shaft therein;

a turret having a boom secured thereto, said turret being secured to said shaft for rotation therewith;

at least one double-acting fluid actuator assembly means including housing means enclosing a linearly movable piston rod having first and second ends, each provided with a piston thereon, and an intermediate section, said intermediate section having a gear rack thereon, said housing means of said at least one fluid actuator assembly including a pair of cylinder housings disposed in axially spaced relation, each respectively having an open end and a closed end, said open end having said piston rod extending through said open ends, with said intermediate portion of said piston rod disposed in the space between said open ends;

a ring gear mounted on said shaft for meshed engagement with said gear rack of said intermediate section;

first fluid actuator support means disposed to receive and support said open ends of said fluid cylinder housing for retention of said gear rack of said piston rod in snug-fitting relation with said ring gear, said first fluid actuator support means being secured to said shaft support means and said fluid actuator housing means for supporting said housing means in said boom support means with said rack gear of said piston rod in the snug-fitting engagement with said ring gear, said first fluid actuator support means including a pair of members having a semi-circular opening therein, securing means for securing said pair of members around said shaft, and a pair of recesses disposed on opposite ends of one of said pair of members to receive and support said open ends of said cylinders therein; and a source of fluid disposed in communication with the interior of said housing means for acting on said pistons for linear displacement thereof to impart rotation to said shaft, said turntable, and said boom.

2. Apparatus as set forth in claim 1 wherein each said cylinder housing includes a port disposed in communication with a fluid reservoir to receive and return fluid to said reservoir responsive to displacement of said pistons.

3. Apparatus as set forth in claim 2 including second fluid actuator support means provided on said enclosure for engaging and supporting said cylinders intermediate to the ends thereof.

4. Apparatus as set forth in claim 3 wherein said cylinder housings are comprised of a plurality of sections disposed in end-to-end abutting relation, and means for securing said sections together.

5. Apparatus as set forth in claim 4 including a single liner mounted in and extending substantially the length of said cylinder housing, said liner being common to each said section.

6. Apparatus as set forth in claim 5 wherein said fluid actuator assembly means is comprised of a pair of fluid actuator assemblies mounted in said boom support, with the first of said pair of fluid actuator assemblies being on a first side of said shaft and the second of said pair of fluid actuator assemblies mounted on a second side of said shaft in substantially parallel relation with said first of said pair of fluid actuator assemblies.

* * * * *